United States Patent [19]

Stroem

[11] Patent Number: 4,651,534

[45] Date of Patent: Mar. 24, 1987

[54] GAS TURBINE ENGINE COMBUSTOR

[75] Inventor: Sigmunn Stroem, Kongsberg, Norway

[73] Assignee: Kongsberg Vapenfabrikk, Norway

[21] Appl. No.: 865,657

[22] Filed: May 16, 1986

Related U.S. Application Data

[63] Continuation of Ser. No. 670,603, Nov. 13, 1984, abandoned.

[51] Int. Cl.[4] ..... F02C 1/00; F02G 3/00

[52] U.S. Cl. ..... 60/732; 60/757; 60/760

[58] Field of Search ..... 60/732, 757, 760, 733, 60/752, 755, 759

[56] References Cited

U.S. PATENT DOCUMENTS

| | | | |
|---|---|---|---|
| 2,446,059 | 7/1948 | Peterson et al. | 60/760 |
| 2,654,996 | 10/1953 | Boninsegni | 60/757 |
| 3,283,502 | 11/1966 | Lefebvre . | |
| 3,831,854 | 8/1974 | Sato et al. | 60/760 |
| 3,910,035 | 10/1975 | Juhasz et al. . | |
| 4,052,844 | 10/1977 | Caruel et al. . | |
| 4,054,028 | 10/1977 | Kawaguchi | 60/732 |
| 4,058,977 | 11/1977 | Markowski et al. . | |
| 4,112,676 | 9/1978 | De Corso . | |
| 4,162,611 | 7/1979 | Carvel et al. | 60/757 |
| 4,192,139 | 3/1980 | Buchheim . | |
| 4,215,535 | 8/1980 | Lewis . | |
| 4,339,925 | 7/1982 | Eggmann et al. | 60/759 |

FOREIGN PATENT DOCUMENTS

| | | | |
|---|---|---|---|
| 1214940 | 4/1966 | Fed. Rep. of Germany | 60/757 |
| 2416909 | 4/1974 | Fed. Rep. of Germany . | |
| 917080 | 12/1946 | France . | |
| 7612195 | 4/1976 | France . | |
| 60323 | 5/1977 | Japan | 60/732 |
| 359323 | 2/1962 | Switzerland | 60/760 |
| 785210 | 10/1957 | United Kingdom . | |

*Primary Examiner*—Carlton R. Croyle
*Assistant Examiner*—Timothy S. Thorpe
*Attorney, Agent, or Firm*—Finnegan, Henderson, Farabow, Garrett & Dunner

[57] ABSTRACT

A combustor for a gas turbine engine including a two-stage burner having first and second combustion and exhaust sections and a burner casing coaxially surrounding the burner to define an annular conduit for reverse flow of inlet air. The burner includes a fuel injector at the upstream end thereof, primary inlet ports introducing 18% of inlet air into the first combustion section, first cooling ports introducing 12% of inlet air into the first combustion section for generating a swirling cooling flow which mixes with primary air after cooling the upstream end of the first combustion section, secondary inlet ports introducing 18% of inlet air into second stage combustion section, second cooling ports introducing 8% of inlet air into the second combustion section to generate a swirling flow which mixes with primary air after cooling the upstream end of the second combustion section, and dilution ports introducing 44% of inlet air into the exhaust section to cool the exhaust gas.

6 Claims, 2 Drawing Figures

GAS TURBINE ENGINE COMBUSTOR

This application is a continuation of application Ser. No. 670,603, filed Nov. 13, 1984, now abandoned.

BACKGROUND OF THE INVENTION

1. Field of the Invention

The present invention relates to combustors for gas turbine engines and, in particular, to a convectionally-cooled 2-stage combustor with low pressure loss and uniform exhaust temperature.

2. Description of the Prior Art

Various types of known combustors or combustion chambers for gas turbine engines are described and discussed in Boyce, *Gas Turbine Engineering Handbook*, Chapter 10, pp. 281–301 (1982). As noted in this reference, combustor performance is measured by efficiency, pressure loss, and temperature profile or distribution.

The subject invention is directed to a combustor for a gas turbine engine having low air velocity and two stage burning which provides an overall temperature distribution factor in the range of 0.07 to 0.12. This is achieved by use of convection cooling and avoidance of conventional film cooling of the combustor walls and a specific distribution of inlet air entering into the combustor.

SUMMARY OF THE INVENTION

The objects and advantages of the invention may be realized and obtained by means of the instrumentalities and combinations particularly pointed out in the appended claims.

In accordance with the invention, as embodied and broadly described herein, the combustor for a gas turbine engine comprises a burner defining an axial fluid-flow path between upstream and downstream ends thereof, the burner including a first combustion section proximate the upstream end, a second combustion section axially downstream of the first combustion section, and an exhaust section proximate the downstream end; a burner casing coaxially surrounding the burner and defining an annular conduit for flow of inlet air from downstream to upstream ends of the burner, the inlet air flow convectionally cooling the burner; means at the upstream end of the burner for introducing fuel into the first combustion section; first primary means for introducing a first primary portion of the inlet air into the first combustion section to generate a combustible fuel-air mixture therein; first cooling means for introducing a first cooling portion of the inlet air into the first combustion section to generate a swirling flow of first cooling air therein, the swirling flow of first cooling air creating an annular cooling layer proximate the upstream end of the first combustion section which substantially mixes with the first primary portion downstream in the first combustion section; second primary means for introducing a second primary portion of the inlet air into the second combustion section to generate a combustible fuel-air mixture therein; second cooling means for introducing a second cooling portion of the inlet air into the second combustion section to generate a swirling flow of second cooling air therein, the swirling flow of second cooling air creating an annular cooling layer proximate the upstream end of the second combustion section which substantially mixes with the second primary portion downstream in the second combustion section; and dilution means for introducing a dilution portion of the inlet air into the exhaust section to cool the exhaust gas of the burner.

Preferably, the first primary means comprises a plurality of first primary openings at the upstream end of the burner disposed around the fuel introducing means, the first cooling means comprises a plurality of first cooling openings at the upstream end of the burner disposed in an annular array radially outward of the first primary openings, the second primary means comprises a plurality of radially oriented second primary openings circumferentially spaced about the burner proximate the downstream end of the first combustion section, the second cooling means comprises a plurality of axially oriented second cooling openings circumferentially spaced about the burner proximate the downstream end of the first combustion section, and the dilution means comprises a plurality of radially oriented dilution openings circumferentially spaced about the burner proximate the downstream end of the second combustion section.

In a preferred embodiment, the first primary portion is approximately 18% of inlet air, the first cooling portion is approximately 12% of inlet air, the second primary portion is approximately 18% of inlet air, the second cooling portion is approximately 8% of inlet air, and the dilution portion is approximately 44% of inlet air.

BRIEF DESCRIPTION OF THE DRAWINGS

The accompanying drawings, which are incorporated in and constitute a part of the specification, illustrate one embodiment of the invention, and together with the description, serve to explain the principles of the invention.

DETAILED DESCRIPTION OF THE PREFERRED EMBODIMENT

Reference will now be made in detail to the present preferred embodiment of the invention, an example of which is illustrated in the accompanying drawings.

The combustor of the invention comprises a burner defining an axial fluid-flow path for gases between upstream and downstream ends thereof and including a first combustion section proximate the upstream end, a second combustion section axially downstream of the first combustion section and an exhaust section proximate the downstream end.

Figure 1:
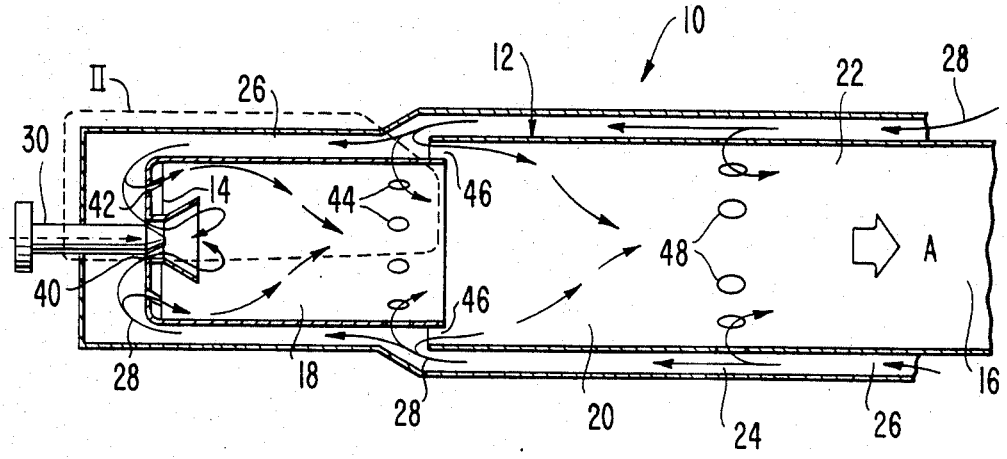
FIG. 1 is a longitudinal cross-sectional view of an embodiment of the invention.

As depicted in FIG. 1, the combustor 10 includes a burner 12 defining an axial fluid-flow path A between an upstream end 14 and a downstream end 16. The burner includes a first combustion section 18 proximate upstream end 14, a second combustion section 20 axially downstream of first combustion section 18 and an exhaust section 22 proximate downstream end 16.

In accordance with the invention, the combustor includes a burner casing coaxially surrounding the burner and defining an annular conduit for flow of inlet air from downstream to upstream ends of the burner, the inlet air flow convectionally cooling the burner. In the embodiment of FIG. 1, burner casing 24 coaxially surrounds burner 12 and defines an annular conduit 26 for flow of inlet air depicted by arrows 28 from downstream end 16 to upstream end 14. Inlet air flow 28 convectionally cools burner 12 by flowing along the outside surface of the burner. Inlet air 28 is generated by the compressor (not shown) of the gas turbine engine and conveyed to annular conduit 26 by conduit means (not shown).

Also in accordance with the invention, the combustor includes means for introducing fuel into the burner proximate the upstream end thereof. Fuel nozzle 30, as seen in FIGS. 1 and 2, projects through upstream end 14 of burner 12 to inject fuel into first combustion section 18.

In accordance with the invention, the combustor includes a first primary means for introducing a first primary part of the inlet air into the first combustion section to generate a combustible fuel-air mixture therein.

Figure 2:
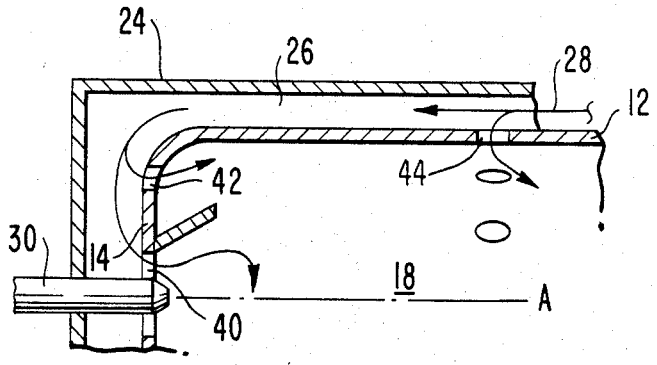
FIG. 2 is an enlarged, partial cross-sectional view of part of the combustor depicted in FIG. 1.

Preferably, as seen in FIGS. 1 and 2, the first primary means comprises a plurality of first primary openings 40 in upstream end 14 of burner 12 disposed around fuel nozzle 30. About 18% of the inlet air 28 flowing through annular conduit 26 enters first combustion section 18 through first primary openings 40 and mixes with fuel injected into first combustion section 18 by fuel nozzle 30. Various structural features may be incorporated within first combustion section 18 proximate fuel nozzle 30 to generate swirling and mixing action between inlet air and fuel.

In accordance with the invention, the combustor includes a first cooling means for introducing a first cooling portion of the inlet air into the first combustion section to generate a swirling flow of first cooling air therein. The swirling flow of first cooling air creates an annular cooling layer proximate the upstream end of the first combustion section which substantially mixes with the first primary portion downstream in the first combustion section.

Preferably, first cooling means comprises a plurality of first cooling openings 42 in the upstream end 14 of the burner 12. First cooling openings 42 are disposed in an annular array radially outward of first primary openings 40. Approximately 12% of inlet air 28 flowing through annular conduit 26 enters first combustion section 18 through first cooling openings 42. First cooling openings 42 are so arranged as to generate a swirling action of cooling air in the upstream end of first combustion section 18. The swirling action of the cooling air generates an annular layer of cooling air at the upstream end of section 18 which is then mixed with the primary air downstream in section 18. The annular layer of cooling air, known as film cooling, does not extend to the downstream end of the first combustion section 18.

In accordance with the invention, the combustor includes a second primary means for introducing a second primary part of inlet air into the second combustion section to generate a combustible fuel-air mixture therein. Preferably, second primary means comprises a plurality of radially-oriented second primary openings 44 circumferentially spaced about burner 12 proximate the downstream end of first combustion secton 18. Approximately 18% of inlet air 28 enters first combustion section 18 at the downstream end thereof through openings 44 and mixes with combustion gases exiting from first combustion section 18 to generate a second stage of burning in second combustion section 20.

The combustor of the invention also includes second cooling means for introducing a second cooling portion of inlet air into the second combustion section to generate a swirling flow of second cooling air. The swirling flow of second cooling air creates an annular cooling layer proximate the upstream end of the second combustion section which substantially mixes with the second primary portion downstream in the second combustion section.

Preferably, second cooling means comprises a plurality of axially-oriented second cooling openings circumferentially spaced about the burner proximate the downstream end of the first combustion section. As seen in FIG. 1, second cooling openings 46 are axially-oriented and open toward the upstream end of the burner 12. The openings are circumferentially spaced about the burner proximate the downstream end of first combustion section 18 and communicate inlet air from annular conduit 26 to the upstream end of second combustion section 20. Second cooling openings 46 are disposed to introduce approximately 8% of inlet air into second combustion chamber 20 in a swirling pattern which generates an annular cooling layer at the upstream end of section 20 which subsequently mixes with the second primary portion. The annular cooling layer does not extend to the downstream end of second combustion section 20.

The combustor of the invention also includes a dilution means for introducing a dilution portion of the inlet air into the exhaust section to cool the exhaust gas from the burner. As seen in FIG. 1, dilution means comprises a plurality of radially oriented dilution openings 48 which receive approximately 44% of inlet air from annular conduit 26 and direct the inlet air into exhaust section 22 of burner 12 to reduce the average temperature of the exhaust gas prior to reaching the turbine.

The gas turbine engine combustors of the invention are capable of high temperature operation with low pressure loss and uniform exhaust temperature. Where a low air velocity (approximately 150 ft/sec.) and two-stage burning are used, the front end of the burner receives 30% of the inlet air providing a fuel-air ratio of 8.5 to 10% which is above stoichiometric, resulting in a low flame temperature. This low flame temperature and two-stage burning provides low heat transfer to the burner wall which is then cooled by convection cooling through the reverse flow of inlet air. The overall structure provides a temperature distribution factor of about 0.07 to 0.12. The temperature distribution factor is defined as maximum temperature minus average temperature divided by average temperature minus inlet temperature.

It will be apparent to those skilled in the art that various modifications and variations could be made in the combustor of the invention without departing from the scope or spirit of the invention.

What is claimed is:

1. A combustor for a gas turbine engine, comprising:

(a) a burner defining an axial fluid-flow path between upstream and downstream ends thereof, said burner including a first portion having a constant cross-sectional area and defining a first combustion zone proximate said upstream end, a second portion having constant cross-sectional area greater than said first area and defining a second combustion zone axially downstream of said first combustion zone, and a third portion defining an exhaust zone proximate said downstream end, said first and second cross-sectional flow areas being sized to provide a combustion gas axial velocity of about 150 ft/sec.;

(b) a burner casing coaxially surrounding said burner and defining an annular conduit for a flow of inlet air from said downstream to said upstream end of said burner, said burner casing being separated from said burner by the air in said inlet air flow;

(c) means at the upstream end of said burner for introducing fuel into said first combustion zone;

(d) first primary means at the upstream end of said burner and communicating with said annular conduit for introducing a first primary portion of said inlet air into said first combustion zone and for directing said first primary portion into mixing contact with said fuel;

(e) first convection cooling means positioned at the upstream end of said burner and communicating with said annular conduit for introducing a first cooling portion in the amount of about 12% of said inlet air into said first combustion zone and for directing said first cooling portion axially at an angle of inclination to the axial fluid-flow path, said angularly directed first cooling air portion generating a swirling flow of air which initially forms an annular layer proximate the burner wall at the upstream end of the first combustion zone and subsequently radially converges toward said axial fluid-flow path into mixing contact with said first primary portion downstream in said first combustion zone;

(f) second primary means positioned in the downstream end of said first burner portion and upstream of said second combustion zone for introducing a second primary portion of said inlet air into said second combustion zone and for directing said second primary portion radially into mixing contact with gases entering said second combustion zone from said first combustion zone, wherein the first burner portion wall between said first cooling means and said second primary means is configured to prohibit the flow of inlet air from said annular conduit to said first combustion zone;

(g) second convection cooling means at the upstream end of said second combustion zone and communicating with said annular conduit for introducing a second cooling portion in the amount of about 8% of said inlet air into said second combustion zone and for directing said second cooling portion axially at an angle of inclination to the axial fluid-flow path, said angularly directed second cooling air portion generating a swirling flow of air which initially forms an annular layer proximated the burner wall at the upstream end of the second combustion zone and subsequently radially converges toward the axial fluid-flow path into mixing contact with primary portion downstream in said second combustion zone; and (h) dilution means for introducing a dilution portion of said inlet air into said exhaust zone and for directing said dilution portion into mixing contact with exhaust gas in said exhaust zone.

2. The combustor of claim 1 wherein said first primary means comprises a plurality of first primary openings in the upstream end of said burner around said fuel introducing means providing fluid communication between said annular conduit and said first combustion zone, each said first primary opening being axially oriented to direct inlet air into mixing contact with fuel in said first combustion zone.

3. The combustor of claim 1 wherein said first cooling means comprises a plurality of first cooling openings in the upstream end of said burner disposed in an annular array radially outward of said first primary openings providing fluid communication between said annular conduit and the upstream end of said first combustion zone, each of said first cooling openings being oriented as to direct inlet air in an axially swirling path in said first burner portion, said first swirling path being annularly proximate the wall of said first burner portion at the upstream end of said first combustion zone and subsequently radially converging toward the axial fluid flow path into mixing contact with the first primary portion of the inlet air downstream in said first combustion zone.

4. The combustor of claim 1 wherein said second primary means comprises a plurality of radially-oriented second primary openings circumferentially spaced about said burner proximate the downstream end of said first burner portion and providing fluid communication between said annular conduit and said first combustion zone, each of said primary openings being radially oriented for directing inlet air into mixing contact with gases exiting said first combustion zone.

5. The combustor of claim 1 wherein said second cooling means comprises a plurality of axially-oriented second cooling openings circumferentially spaced about said burner proximate the upstream end of said second burner portion and providing fluid communication between said annular conduit and the upstream end of said second combustion zone, each of said second cooling openings having an entrance directed toward the upstream end of said burner and being oriented for directing inlet air into an axially swirling path in said second burner portion, said second swirling path being annularly proximate the second burner portion wall in the upstream end of the second burner portion, the air from said second cooling openings subsequently radially converging toward the axial fluid flow path into mixing contact with the second primary portion of the inlet air downstream in said second combustion zone.

6. The combustor of claim 1 wherein the dilution means comprises a plurality of radially oriented dilution openings circumferentially spaced about said third burner portion wall proximated the downstream end of said second combustion zone and providing fluid communication between said annular conduit and said exhaust zone, each of said dilution openings being oriented to direct inlet air radially into mixing contact with exhaust gases in said exhaust zone.

* * * * *